US007726100B2

(12) United States Patent
Bigoni

(10) Patent No.: US 7,726,100 B2
(45) Date of Patent: Jun. 1, 2010

(54) METHOD AND STRUCTURE FOR ENCLOSING A PACKAGING MACHINE

(75) Inventor: Pietro Bigoni, Massa Lombarda (IT)

(73) Assignee: I.M.A. Industria Macchine Automatiche, Ozzano Emilia (Bologna) (IT)

( * ) Notice: Subject to any disclaimer, the term of this patent is extended or adjusted under 35 U.S.C. 154(b) by 0 days.

(21) Appl. No.: 10/560,688

(22) PCT Filed: Jun. 17, 2004

(86) PCT No.: PCT/IB2004/002017

§ 371 (c)(1),
(2), (4) Date: Dec. 14, 2005

(87) PCT Pub. No.: WO2004/110867

PCT Pub. Date: Dec. 23, 2004

(65) Prior Publication Data

US 2006/0144022 A1 Jul. 6, 2006

(30) Foreign Application Priority Data

Jun. 19, 2003 (IT) ..... BO2003A0374

(51) Int. Cl.
*B65B 47/00* (2006.01)

(52) U.S. Cl. ..... 53/453; 53/103; 53/167; 53/510; 53/561

(58) Field of Classification Search ..... 53/84–86, 53/103, 393, 453, 510–512, 559, 561, 167
See application file for complete search history.

(56) References Cited

U.S. PATENT DOCUMENTS

| | | | | |
|---|---|---|---|---|
| 2,721,019 | A | 10/1955 | Gauvreau | |
| 3,711,939 | A | 1/1973 | Stoll | |
| 3,942,299 | A * | 3/1976 | Bory | 53/425 |
| 4,590,734 | A * | 5/1986 | Ueda | 53/52 |
| 4,923,362 | A * | 5/1990 | Fryk | 414/700 |
| 5,097,649 | A * | 3/1992 | Ueda et al. | 53/167 |
| 5,326,316 | A * | 7/1994 | Hashimoto et al. | 454/187 |
| 5,431,599 | A * | 7/1995 | Genco | 454/187 |
| 5,810,060 | A | 9/1998 | Bolz et al. | |
| 5,912,184 | A * | 6/1999 | Young | 438/692 |
| 5,997,399 | A * | 12/1999 | Szatmary | 454/187 |
| 6,134,866 | A * | 10/2000 | Schoenewolff et al. | 53/561 |
| 6,185,913 | B1 * | 2/2001 | Cappi et al. | 53/511 |
| 6,368,208 | B1 * | 4/2002 | Minoshima | 454/187 |
| 6,675,555 | B1 * | 1/2004 | Monti | 53/167 |
| 2002/0036760 | A1 * | 3/2002 | Udagawa et al. | 355/53 |

FOREIGN PATENT DOCUMENTS

EP 0 721 888 A 7/1996

* cited by examiner

*Primary Examiner*—Thanh K Truong
(74) *Attorney, Agent, or Firm*—William J. Sapone; Coleman Sudol Sapone P.C.

(57) ABSTRACT

A method and a structure (1) are provided for enclosing a packaging machine (100), which can be divided in at least two work areas or portions (110; 130, 120) having different operation tasks, arranged one after another along a packaging line (2) of the machine (100). The structure (1) includes a plurality of enclosing panels (P), suitably assembled together to form enclosing chambers (3, 4) for protection of each of the work portions (110; 130, 120). At least one of the enclosing chambers (3) is aimed at enclosing, a pressurized environment and at least the other chamber (4) is aimed at enclosing an environment, whose pressure is substantially constant and equal to the outside pressure.

11 Claims, 2 Drawing Sheets

METHOD AND STRUCTURE FOR ENCLOSING A PACKAGING MACHINE

FIELD OF THE INVENTION

The present invention relates to packaging articles in a protected environment.

In particular, the invention relates to a method and a structure for enclosing a packaging machine in order to isolate the machine from the outside, so as to prevent the machine from contamination by agents present in the outside surrounding area.

BACKGROUND OF THE INVENTION

In the field of the automatic packaging machines, in particular machines for packaging pharmaceutical products into containers, to which the following description refers explicitly without losing its generality, the packaging machines, or the parts thereof, are often isolated from the outside environment, in order to prevent the product being packaged, or their containers, from contamination.

In general, if the pharmaceutical product being packaged is dangerous for the health of operators who work near the packaging machines, it is also essential to avoid spreading of remains or parts of the product in the surrounding area.

For this purpose, specific solutions for packaging pharmaceutical products in a controlled atmosphere have been proposed.

These solutions include apparatuses provided for performing the packaging operation in protected environment, that is for completely isolating the whole packaging machine, and in general the whole packaging area, from the outside area, in order to avoid any type of cross contamination between the product being packaged, their containers and the outside environment.

The above mentioned apparatuses usually include big enclosing structures, having inside work areas with a controlled purity, systems for sterilization and decontamination, and complicated systems for micro filtrations of the air exchanged with the outside.

Since they have to maintain very high isolation standards, the above apparatuses must be very complicated and sophisticated structurally and functionally, and moreover, they are very expensive.

SUMMARY OF THE INVENTION

The object of the present invention is to propose an enclosing structure, which overcomes the above mentioned drawbacks and problems.

In particular, an object of the present invention is to propose an enclosing structure for a packaging machine, which is simple, under consideration of both the construction point of view, and elements assembling.

Another object of the present invention is to propose an enclosing structure, which isolates the critical parts of a packaging machine in best way and at a lower cost.

An enclosing structure for a packaging machine is provided according to the present invention, said packaging machine including at least two work areas or portions having different operation tasks, arranged one after another along a packaging line of the machine; the structure being characterized in that it includes covering panel-shaped means suitably assembled together to form a enclosing chamber for protection of each of said work portions; at least one of said chambers being provided for defining a pressurized environment and at least the other chamber being aimed at defining a closed environment with a pressure equal to the outside pressure.

The present invention relates also to a method for enclosing a packaging machine.

A method for enclosing a packaging machine is therefore provided according to the present invention, the method being characterized in that said packaging machine is divided in at least two separate work areas or portions having different operation tasks; each of said work portions is enclosed by, and situated within a relative enclosing chamber protecting said portion; the inside of at least one of said chambers forms an environment under pressure and the inside of at least the other chamber forms a closed environment, whose pressure is equal to the outside pressure.

BRIEF DESCRIPTION OF THE DRAWINGS

Now the invention will be described in detail with reference to preferred, but not limiting embodiment shown in enclosed figures, in which.

BEST MODES OF CARRYING OUT THE INVENTION

Figure 1:
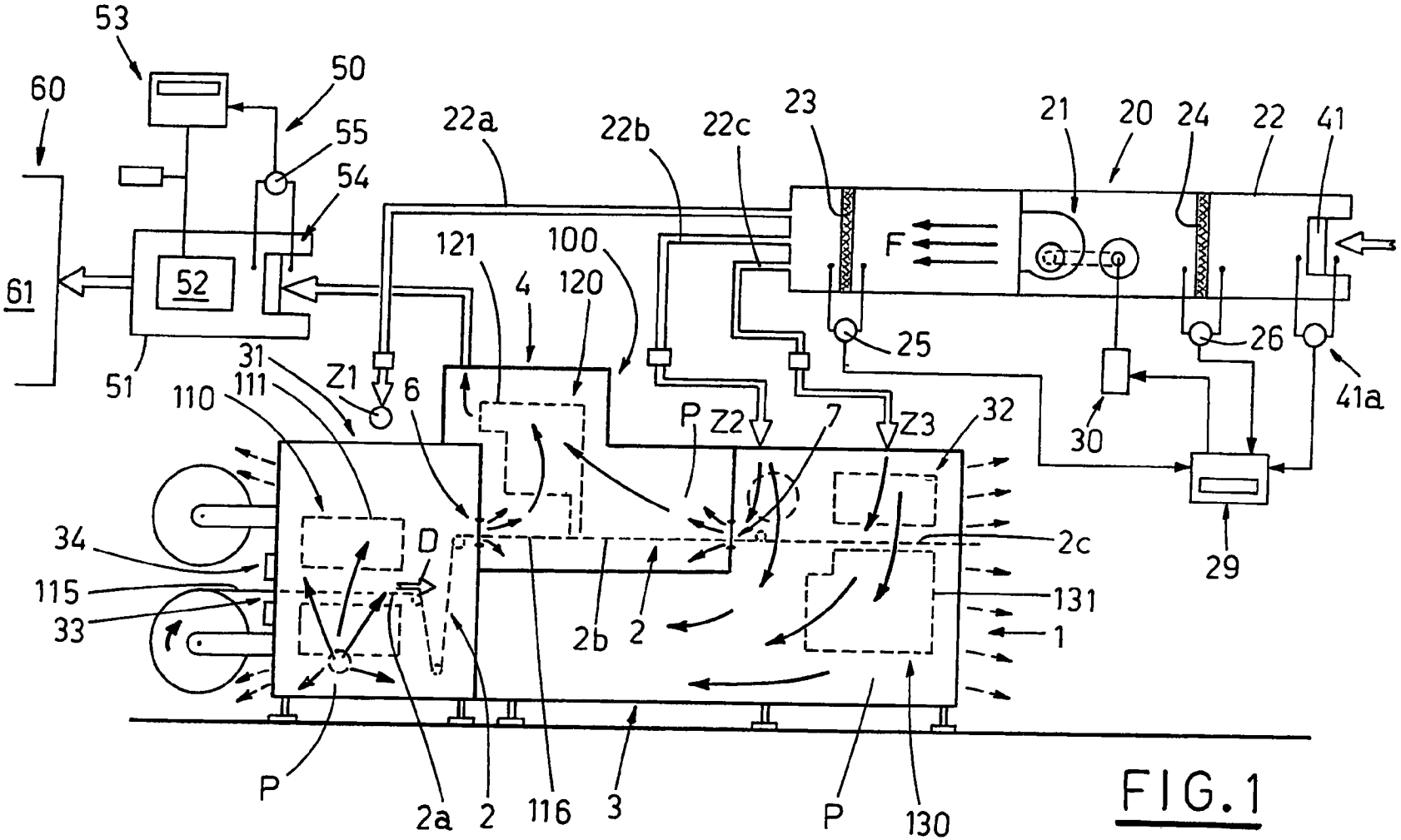
FIG. 1 is a block diagram, with some parts removed for sake of clarity, of the enclosing structure proposed by the present invention.

With reference to FIG. 1, reference numeral 1 indicates a structure for enclosing an automatic packaging machine 100, obtained according to a preferred embodiment of the invention.

The packaging machine 100, in this particular, but not limiting case, to which reference will be made later on without losing generality, is an automatic machine for packaging tablets, pills or other similar pharmaceutical products (not shown) into containers or blister packs (known and not shown) along a packaging line 2.

Also according to FIG. 1, the machine 100 is substantially of the type which can be divided in more separate work areas or portions having different operation tasks.

One of the work portions 110 includes an initial section 2*a* of the packaging line 2, along which a blister packs production/feeding station 111 is situated.

More precisely, the station 111 is a station, in which blisters (known and not shown) are made on a band 115 of a heat-formable material, unwinding in a direction D to form, downstream of the station 111, a corresponding blister band 116.

The machine 100 includes also a work portion 120, which is situated downstream of the portion 110, and which includes an intermediate section 2*b* of the packaging line 2, along which a station 121 is situated for feeding the pharmaceutical products to the blisters made on the band 116.

A work portion 130 is situated after the portion 120 and includes a final section 2*c* of the packaging line 2, along which a station 131 is situated for closing blister packs filled with the pharmaceutical products by adhering a suitable material, likewise a band, to the blister band 16, in accordance with known and not shown method.

The enclosing structure 1 according to the present invention includes substantially two sections or units, substantially closed and delimited externally by suitable panels, as for example panels P made of appropriate transparent plastic or similar material and having suitable dimensions, properly assembled together.

In particular, a first section or unit includes a first enclosing chamber 3, which encloses the work portions 110 and 130 of the packaging machine 100, in order to prevent the structural elements forming the portions 110 and 130 from outside contamination.

A second section or unit includes a second enclosing chamber 4, which encloses the portion 120 of the packaging machine 100, so as to prevent the closed inner environment defined by the chamber 4 from the contamination, as well as to prevent the outside environment from the contamination caused by possible leaks of particles or powders of pharmaceutical products from the inside of the chamber 4, leaks of powders, which can occur mainly during e.g. the feeding pharmaceutical products in the station 121.

In order to eliminate the above contaminations by the outside environment, specifically the first enclosing chamber 3 encloses an environment with a pressure higher than the outside environment pressure, while in order to eliminate contaminations from and to the outside environment, the second enclosing chamber 4 encloses a closed environment with substantially constant pressure condition and with a pressure equal to the outside pressure; this is obtained by means of a circulation of flows of filtered and purified air, as it will be better explained later on.

The second enclosing chamber 4 communicates with the first chamber 3 in the regions corresponding to slots or passages 6 and 7, through which the air passes only from the chamber 3 to the chamber 4 (FIG. 1), due to the effect created by the pressure difference between the inner environment in the chamber 3 and the constant environment defined inside the chamber 4.

The first enclosing chamber 3 is divided in two parts 31 and 32, which do not communicate directly, respectively a fore part 31 downstream of the direction D, in which the band 115 unwinds, and a rear part 32, upstream of the same direction D.

Figure 2:
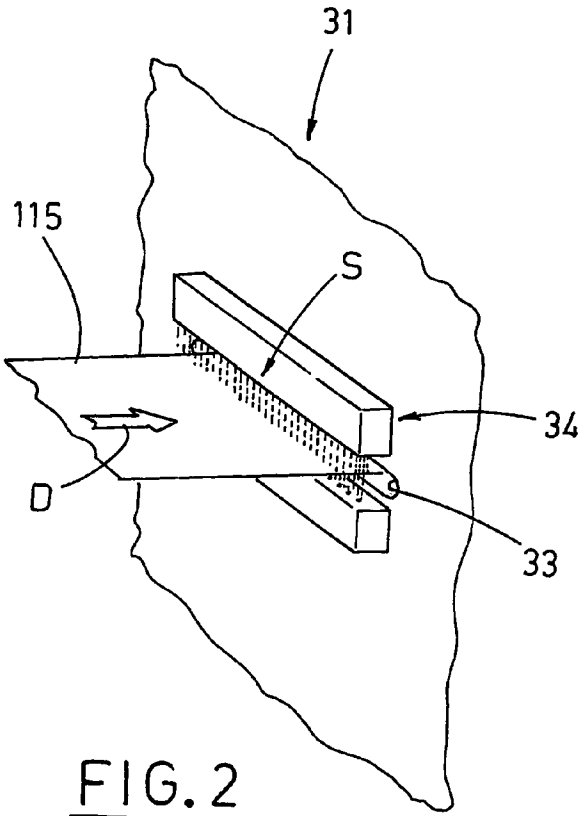
FIG. 2 is a schematic prospective view of a detail of the structure shown in FIG. 1.

According to what is better shown in FIGS. 1 and 2, the fore part 31 of the chamber 3 defines a covering enclosure of the forming station 111 and of the initial section 2*a* of the packaging line, while the rear part 32 of the chamber 3 defines a covering enclosure of the closing station 131 and of the final section 2*c* of the packaging line 2.

The first enclosing chamber 3 has an inlet aperture 33*a*, which is situated in one side, and through which the heat-formable band 115 enters the chamber 3.

A fluid-dynamic barrier 34 acts near the inlet aperture 33*a* and its jets S of compressed air act on the band 115, so as to remove therefrom possible impurities or powders.

The jets S are situated directly above and outside of the inlet aperture 33 and extend along the whole length thereof.

Figure 3:
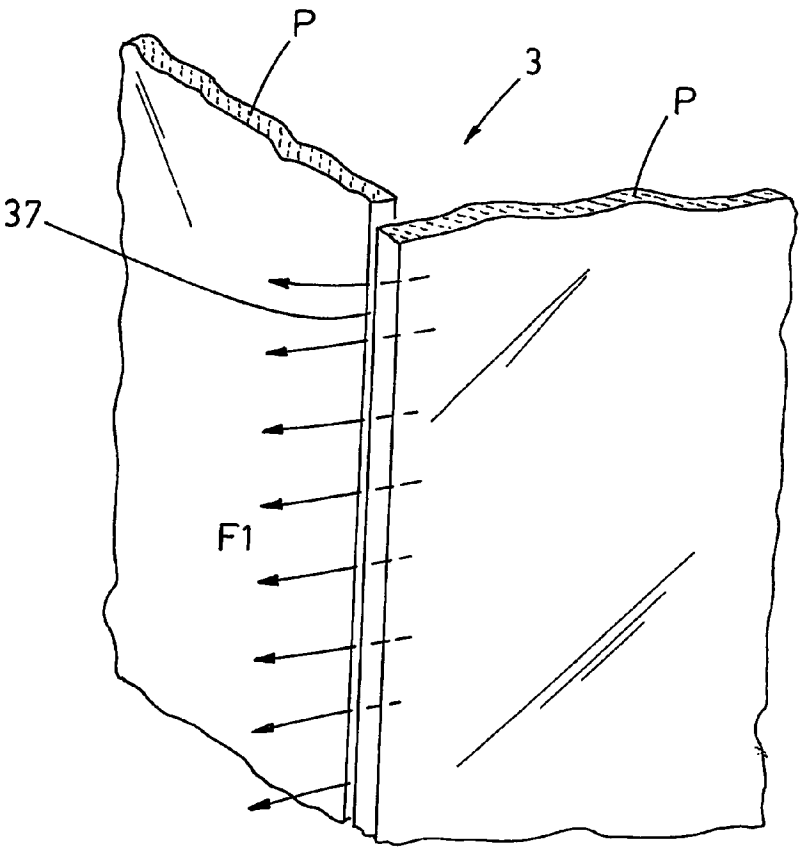
FIG. 3 is a schematic prospective view of another detail of the structure shown in FIG. 1.

According to what is shown in FIG. 3, an intermediate space 37 of suitable dimension is situated in the connection area of respective adjacent extremities of two general panels P' and P", adjacent to each other and forming the chamber 3 of the structure 1.

The intermediate space 37 allows the air present inside the chamber 3 to go outside in a continuous flow of air f from the inside of the chamber 3 toward outside.

The continuous flow of air f from the inside toward outside through the intermediate space 37 is created by the effect of the over-pressure in the first chamber 3 with respect to the pressure of the environment outside the chamber 3 and practically, its object is to prevent the outside air and the powder particles, impurities and the like present therein, from entering the first chamber 3: in this way, the pressurized atmosphere present inside the chamber 3 is maintained extremely well.

The second enclosing chamber 4, which encloses the feeding and filling station 121 and an intermediate section 2*b* of the packaging line 2, is made in such a way, as to be substantially tight-closed and it communicates with the fore part 31 and the rear part 32 of the first enclosing chamber 3 through the above described passages 6, 7, respectively in the regions corresponding to the connection points between the intermediate section 2*b* and the initial 2*a* and final 2*c* sections of the line 2.

Also according to what is shown in FIG. 1, the structure 1 includes means 20 for generating a controlled flow of air F, which are aimed at withdrawing a prefixed quantity of air from the outside environment and at introducing it, suitably filtered and purified, into the first enclosing chamber 3 through a plurality of inlet points Z1, Z2 and Z3 (shown in broken line in FIG. 1).

The generating means 20 include a pump 21, with variable delivery, including for example a turbine operated by an electric motor, and situated inside an input duct 22.

The duct 22 sets the outside environment in communication with the above mentioned first chamber 3, through a plurality of derived ducts 22*a*, 22*b*, 22*c*, which bring the air to the chamber 3 in the points Z1, Z2 and Z3.

A main filter 23, situated downstream of the pump 21, with respect to the flow F of air generated thereby, is aimed at keeping possible impurities present in the air introduced into the first chamber 3.

A secondary filter 24, situated upstream of the pump 21, is aimed at preliminary filtering the air and then, at helping the filtering action of the main filter 23, before its action.

The air depuration quality, that is the number of particles for volume unit present in the filtered air and their maximum size, will depend specifically on the quality and the class of the filters 23 and 24.

The generator 20 includes also, for each filter 23, 24, a corresponding sensor 25, 26, aimed at detecting variations of the volume of the air flow near the filters 23, 24.

In particular, the sensors 25 and 26 are preferably differential manostats, which measure the differences of pressure upstream and downstream of the relative filter 23, 24, where the progressive increases of the differences demonstrate that the relative filter becomes gradually obstructed.

The sensors 25 and 26 are connected to a control unit 29, to which they send signals related to the above mentioned measures.

The control unit 29, which can be programmed and is of the type commonly used in the control apparatuses, is connected at the outlet to an inverter group 30, which feeds the motor of the pump 21.

The unit 29 is programmed in such a way, as to pilot the inverter 30 to increase or diminish the speed of the pump 21 as a function of the differential pressure measured at the filters 23 and 24, in order to maintain constant the range of the pump 21.

A flow measuring element 41, situated upstream of the secondary filter 24, is aimed at independent flow measuring in the duct 22.

A further sensor or differential manostat 41*a*, situated near the measuring element 41, is connected to the control unit 29 for informing the latter about the pressure drop in the flow measuring element 41.

The structure 1 includes also air withdrawing means 50, aimed at setting the second enclosing chamber 4 in communication with the suction group 60, to allow withdrawal of a predetermined flow F' of air from the second chamber 4, containing the impurities, mainly in powder form, released by the pharmaceutical product during the feeding of the latter and filling the blisters of the band 116.

The amount of the flow F' of air withdrawn by the group 60 is adjusted, so as to balance the air entering the chamber 4 through the passages 6, 7 communicating with the first chamber 3, and so as to maintain the second chamber 4 with a pressure substantially equal to the pressure of the outside environment, as and for the purposes specified before.

The means 50 include an outlet duct 51, which connects the second chamber 4 to the suction group 60.

A valve 52, situated inside the outlet duct 51, has a variable and adjustable aperture, so as to define the withdrawing quantity.

An adjustment central unit 53, connected to the valve 52, is aimed at controlling the aperture of the valve 52, to define the quantity of the withdrawn air.

The central unit 53 can be programmed, and is of the substantially known type, and is aimed at allowing automatic or manual adjustment of the aperture of the valve 52.

In use, an operator can control manually the valve 52, after having been alerted by the fact that the pressure sensors (known and not shown), suitably situated in the second chamber 4 for signaling the inner pressure deviations with respect to the atmospheric pressure, reach the minimum and maximum threshold values.

It is also possible, using techniques entirely known and accessible to those skilled in the field, to introduce a feedback control, commanded by the adjustment central unit 53, to avoid or at least reduce the operator's intervention.

A flow measuring element 54, situated upstream of the valve 52, includes also a sensor or differential manostat 55 connected to the adjustment central unit 53, to take other measurements, independent one from another, of the outgoing flow F' of air.

The above mentioned suction group 60 includes generally a suction intake provided in the plant, in which the structure 1 and the packaging machine 100 operate.

The air is conveyed from the above suction intake toward a centralized depuration plant, indicated generally with 61 in FIG. 1, which filters the air and eliminates impurities contained therein, according to their type and to regulations in force.

The containing structure 1 obtained according to the present invention allows advantageously to enclose and protect the packaging machine 100 from contaminations and/or impurities coming from the outside environment, respecting wholly the modern and high isolation standards.

Moreover, it allows to avoid the outflows of powders of pharmaceutical product, which are potentially dangerous for the environment and for the workers responsible for the packaging machine effectiveness control.

All this is obtained in a safe way, using technical solutions of simple and cheap construction, also due to modular configuration with separate sections of the containing structure, which allows easy and quick assembling and mounting for enclosing packaging machines of any type and dimension.

It is understood that what above has been described as a pure, not limiting example. Therefore, possible variants and changes of the invention remain within the protective scope of the present technical solution, as described above and claimed below.

The invention claimed is:

1. An enclosing structure for a packaging machine, said packaging machine including at least two work portions having different operational tasks, arranged one after another along a packaging line of said packaging machine, the enclosing structure comprising:

enclosing panel-shaped means assembled together to form at least two enclosing chambers for protecting each of said two work portions arranged one after another along said packaging line during operation of said packaging machine, a first enclosing chamber enclosing an environment at a pressure higher than an outside pressure disposed about a work portion requiring said pressurized environment and a second enclosing chamber enclosing an environment with a pressure equal to the outside pressure disposed about a work portion located upstream or downstream of said first portion along said packaging line;

means for generating at least one flow of high pressure air delivered only into said first enclosing chamber for maintaining a pressurized environment therein, and wherein said high pressure air is the only source of air supply that enters the first enclosing chamber;

passages only provided in said second enclosing chamber between the first enclosing chamber and the second enclosing chamber, the only air entering the second enclosure being permitted to pass solely from said first enclosing chamber with the pressurized environment to the second enclosing chamber with the pressure equal to the outside pressure;

suction means for withdrawing air from an inside of said second enclosing chamber in an amount sufficient to maintain the pressure inside said second enclosing chamber substantially constant and equal to the outside pressure, during operation of said work portions within the enclosing structure;

means cooperating with said generating means and with said suction means for purifying a flow of air at an outlet of said second enclosing chamber.

2. A structure as claimed in claim 1, wherein said packaging machine is used for packaging pharmaceutical products in containers, said work portions being a first work portion including at least one station for feeding said pharmaceutical products, and a second work portion including at least one station for producing/feeding said containers, said first enclosing chamber providing a pressurized environment for enclosing said second work portion and said second enclosing chamber enclosing said first work portion of said packaging machine during operation thereof.

3. A structure as claimed in claim 2, wherein said packaging machine includes a third work portion having at least one station for closing said containers, said first enclosing chamber providing a pressurized environment for enclosing said second and third portions during operation thereof.

4. A structure as claimed in claim 2, wherein said packaging machine is a blistering machine for packaging pharmaceutical products in blister packs, said second work portion including a station for forming blisters on a band material, thereby forming a blister band, said third work portion including a station for closing said blister band.

5. A structure as claimed in claim 4, wherein said first enclosing chamber has at least one mouth for allowing said band material to move forward in a defined feeding direction (D) along said packaging line, said mouth having fluid-dynamic barrier means for acting on said band material to remove any contaminants therefrom.

6. A structure as claimed in claim 1, wherein said first enclosing chamber includes a plurality of panels, said first enclosing chamber having an intermediate space (37), located in a connection area between two panels, said intermediate space allowing air present inside the first enclosing chamber (3) to exit the first chamber in a continuous flow.

7. A structure as claimed in claim 1, wherein said generating means include at least one pump for drawing air from the outside environment and conveying the air through introduction ducts toward said first enclosing chamber, said purifying means including filter means for filtering the air before introducing the air into the first enclosing chamber;

sensor means connected to said filter means for detecting variations in a volume of air flow and for sending control signals to a control unit, said control unit connected to means for operating said pump.

8. A structure as claimed in claim 7, wherein said filter means comprise a main filter located in said introduction ducts downstream of said pump and having first sensor means connected thereto, and, a secondary filter located upstream of said pump and having second sensor means connected thereto.

9. A structure as claimed in claim 8, wherein said first and second sensor means are differential manostats for measuring a difference in pressure upstream versus downstream of each respective filter.

10. A structure as claimed in claim 1, wherein said suction means include an outlet duct connecting said second enclosing chamber to a suction group, at least one valve located in said outlet duct and having a variable aperture, so as to vary a quantity of air withdrawn from said second enclosing chamber, a central adjustment unit controlling the aperture of said valve to adjust the air flow withdrawn from said second enclosing chamber, and, flow measuring means located in said outlet duct and connected to said central adjustment unit for measuring said flow of air withdrawn from said second enclosing chamber and for sending a control signal to the central adjustment unit for adjusting the air flow withdrawn from said second chamber.

11. A structure as claimed in claim 10, wherein said flow measuring means include a differential manostat sensor.

* * * * *